United States Patent [19]

Faron et al.

[11] 4,176,018

[45] Nov. 27, 1979

[54] ELECTROLYTE AND PROCESS FOR ELECTROLYTIC PRODUCTION OF FLUORINE

[75] Inventors: Robert Faron, Nyons; Annie Cathala, Livron, both of France

[73] Assignee: Produits Chimiques Ugine Kuhlmann, Paris, France

[21] Appl. No.: 957,447

[22] Filed: Nov. 3, 1978

Related U.S. Application Data

[63] Continuation-in-part of Ser. No. 666,495, Mar. 12, 1976, Pat. No. 4,139,447.

[30] Foreign Application Priority Data

Mar. 21, 1975 [FR] France ..... 75 09564

[51] Int. Cl.[2] ..... C25B 1/24; C25B 9/00

[52] U.S. Cl. ..... 204/60; 204/128; 204/247; 204/252; 204/256

[58] Field of Search ..... 204/94, 98, 128, 244, 204/251, 256, 258, 68, 247, 60, 61

[56] References Cited

U.S. PATENT DOCUMENTS

| | | | |
|---|---|---|---|
| 2,996,446 | 8/1961 | Davies et al. | 204/60 X |
| 3,000,801 | 9/1961 | Davies et al. | 204/60 |
| 3,146,179 | 8/1964 | Davies | 204/247 X |
| 3,196,091 | 7/1965 | Mastrangelo | 204/60 |
| 3,385,775 | 5/1968 | Edwards | 204/60 X |
| 3,673,076 | 6/1972 | Juckniess | 204/60 X |
| 4,125,443 | 11/1978 | Grant et al. | 204/247 X |

*Primary Examiner*—Arthur C. Prescott
*Attorney, Agent, or Firm*—Dennison, Dennison, Meserole & Pollack

[57] ABSTRACT

An electrolyte and process for the low temperature industrial electrolytic production of fluorine gas utilizing a ternary electrolyte having a composition of:

$NH_4F$=5 to 20 mol % of $NH_4$+KF

HF=40 to 45%, by weight, of $NH_4F$+KF+HF wherein the working temperature of the electrolyte is maintained between about 50° C. and about 75° C.

5 Claims, 12 Drawing Figures

ELECTROLYTE AND PROCESS FOR ELECTROLYTIC PRODUCTION OF FLUORINE

BACKGROUND OF THE INVENTION

This application is a continuation-in-part of application Ser. No. 666,495, filed Mar. 12, 1976, now U.S. Pat. No. 4,139,447, issued Feb. 13, 1979.

This invention concerns a process for elemental fluorine production which operates with greater economy than known processes.

The need for elemental fluorine will develop rapidly in the next few years. In particular, fluorine gas is used for uranium hexafluoride production from which uranium enrichment is processed by diffusion. The classical method is described in a report by R. A. Ebel and G. H. Montillon, "Fluorine Generator Development", No. K-858 subject catagory, chemistry, Carbide and Chemicals Company, Union Carbide and Carbon Corp., published on Jan. 22, 1952, issued in "category chemistry" in the distribution list for United States Atomic Energy Non-Classified Research and Development Reports, TID 4500 of July 17, 1951.

This method consists in electrolyzing a molten mixture of potassium fluoride and hydrogen fluoride approximating in composition KF·2HF contained in a rectangular tank of mild steel or "Monel" (International Nickel Co. registered trademark for a nickel-copper alloy, 63—68% of nickel with minute quantities of iron, manganese, silicon and carbon). In this electrolyzer the carbon anodes and the iron or "Monel" cathodes are connected in parallel and held in position by the current leads without contact with the tank sides to avoid the shunting of current.

The following figures will assist in understanding the state of the art and the process according to the invention.

Figure 12:
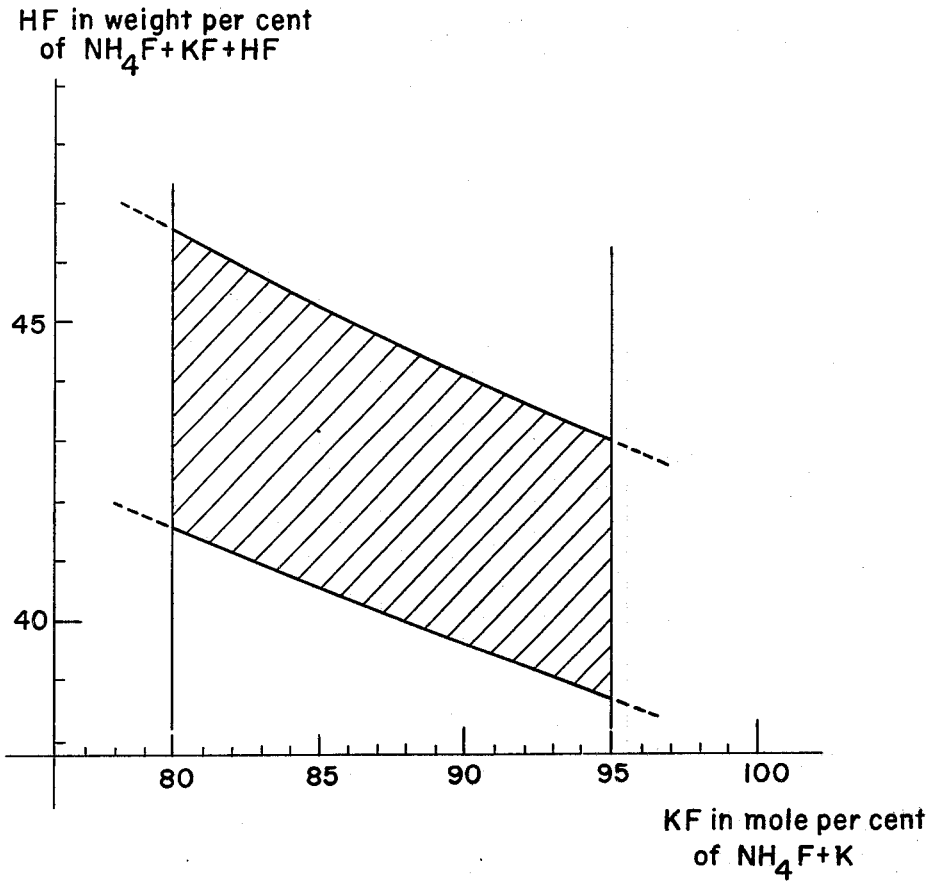

FIG. 12 graphically shows the preferential range of composition of the electrolyte of the process of the present invention.

Figure 1:
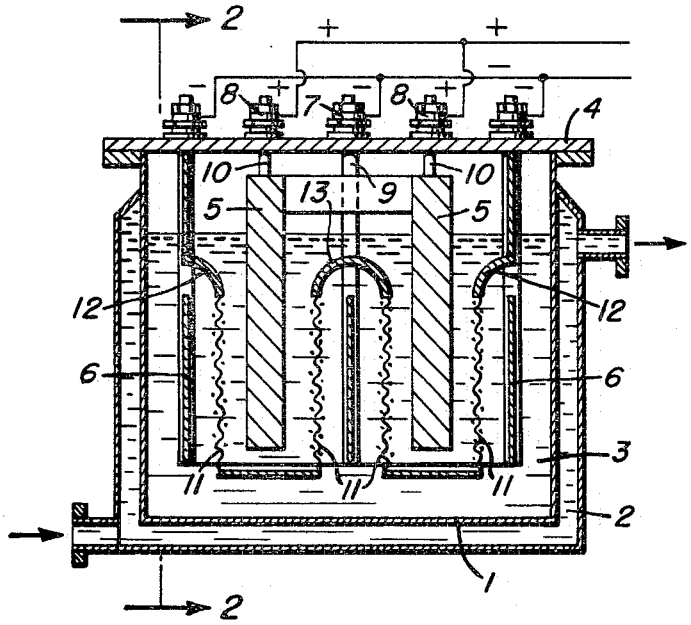
FIG. 1 PRIOR ART
FIG. 1 is a vertical section perpendicular to the electrodes of a known industrial electrolyzer.
Figure 2:
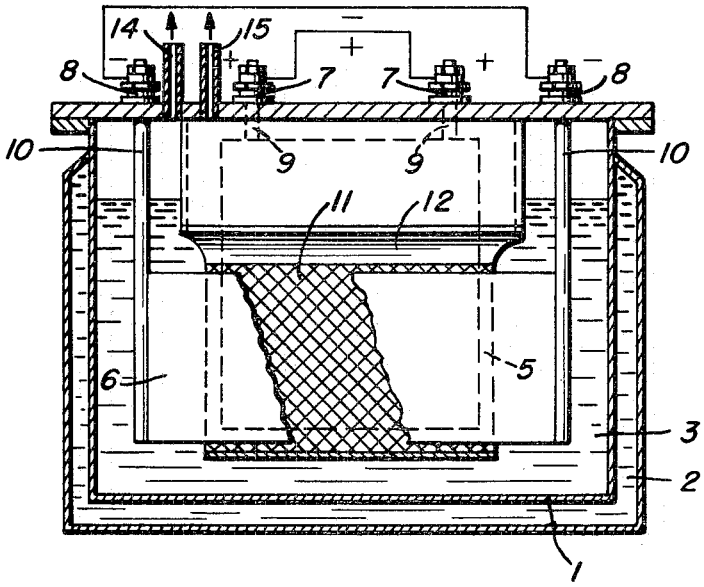
FIG. 2 PRIOR ART
FIG. 2 is a section parallel to the electrodes of the electrolyzer of FIG. 1.

FIGS. 1 and 2 show an industrial electrolyzer corresponding to the classical technique which has just been referred to. The mild steel double walled rectangular electrolyzer tank 1 is water cooled 2. It contains the molten electrolyte 3 approximating in composition KF·2HF. A "Monel" top 4 is tightly bolted to the tank.

Electrolysis is achieved between the carbon anodes 5 and the iron cathodes 6 held by current leads 9 and 10 which project through the top 4 by insulated holes 7 and 8 and are connected to a direct current source (not shown). There is no contact between these electrodes and the bottom or the walls of the tank. Anodes and cathodes are connected in parallel.

Diaphragms 11 made of a fine "Monel" wire screen are placed between anodes and cathodes. These diaphragms are topped by tightly fixed "Monel" partitions 12. These partitions are longer than the electrodes, are closed on both sides and dip in the bath. The median partition 13 which looks like an inverted gutter is only fixed at both ends. So are delimitated closed volumes surrounding the upper part of each electrode, and limited by the bath, the partitions 12 and 13 and the top 4. Thus, hydrogen can be collected on the cathodes any fluorine on the anodes without any risk of mixing. Hydrogen is piped outside the electrolyzer through the tube 14 and fluorine through the tube 15.

The melding point of the bath being around 70° C, the usual working temperature ranges from 80 to 110° C. In these conditions, due to the partial pressure of hydrogen fluoride over the KF·2HF system, the fluorine and the hydrogen collected contain around 6 to 8% in volume of HF.

The working voltage of electrolysis is about 10 volts and the current density is around 15 A/dm$^2$. The average Faraday efficiency approximates 90% and the energy efficiency is very low because the reversible voltage of decomposition of HF reaches only about 2.8 volts. This type of prior art electrolyzer is characterized by serious drawbacks: its low productivity; a bad energy efficiency which tends to overheat the bath and limits the working current densities; the high working temperature that enhances material corrosion by the bath and by HF; and high maintenance costs.

For many years scientists have tried to improve the efficiency and productivity of the fluorine industrial electrolyzer. In French Pat. No. 2 082 366, published Dec. 10, 1971, of Societe des Usines Chimiques de Pierrelatte, it is proposed to replace the usual electrolyte by ammonium fluoride containing 55 to 63 of HF in weight percent. This electrolyte has a melting point between −6° C. and +23° C., and allows working at room temperature. In these conditions, the HF partial pressure is lowered and the HF content of the produced gases is smaller. The lower resistivity of this electrolyte enables an increase in the current density and its lower anodic overvoltage improves the energy efficiency. The same patent also teaches the possibility of replacing up to a fourth of $NH_4F$ in molar fraction by the same quantity of KF. The French patent is not considered to suggest to one skilled in the art parameters of the interrelationship of the constituent components of the electrolyte of the process of the present invention that provide the present improvement. French Pat. No. 2 145 063, published Mar. 23, 1973 first addition to French Pat. No. 2 082 366, proposes to substitute for steel tanks less expensive plastic tanks, whose use is made possible by the lower working temperature permitted by $NH_4F$—HF.

THE INVENTION

In spite of these improvements much could still be done to realize a process having improved current and energy efficiencies and higher capacity. To meet this goal, it was necessary to lower the energy losses due to bad electrical contacts between electrodes and current leads and to reduce the distance between electrodes and increase the current density with a temperature of bath as low as possible by providing an electrolyte in accordance with the present invention while avoiding current losses between the electrodes and the walls of the tank.

The present process is particularly suitable for use with improved electrolyzers for fluorine production as disclosed in Ser. No. 666,495.

A significant aspect of the process of the present invention is the providion of a $NH_4F+KF+HF$ electrolyte having a gross composition wherein:

The electrolyte has a $NH_4F$ content expressed in mol % in relation to the molar total of $NH_4F+KF$, which $NH_4F$ content is between about 5 and about 20 mol %;

The KF content is complementary and thus varies from about 95 to about 80 mol % in relation to the molar total of $NH_4F+KF$; and, The HF content, in % by weight in relation to the $NH_4F+KF+HF$ total, it between about 40 and about 45% by weight.

The fusion point of these electrolytes varies between approximately 45° C. and approximately 60° C.

Electrolysis tests using electrolytes of the above composition range, and using a preferred electrolyte comprising:

$$\frac{NH_4F}{NH_4F + KF} = 9 \text{ mol } \%$$

$$\frac{KF}{NH_4F + KF} = 91 \text{ mol } \%$$

and $$\frac{HF}{NH_4F + KF + HF} = 42\% \text{ by weight}$$

have established the following:

First, certain synthetic resin materials have been found to have resistance to attack with respect to fluorine-containing electrolytes. The materials easily withstand a very long duration of contact with $NH_4F$, KF and HF base electrolytes at temperatures of up to 70 to 80° C. and even a little higher.

The electrolyte of the process of the invention as exemplified by the experiments, as set forth in the following examples, has a fusion point of between about 45° C. and 60° C, and with efficient cooling of the electrolysis cell, it is possible to limit the superheat between around 10 and 20° C. The temperature of the electrolyte thus does not usually exceed about 80° C. This operating temperature permits remarkable reduction of the HF vapor concentration in the electrolysis gases. This concentration, which is approximately 7% when a binary mixture of KF·2HF composition is electrolyzed at a temperature of 95° C, is reduced to 4% for an electrolyzing temperature of 70° C. This causes a notable reduction of consumption of material and electrical energy. It is obvious that in practice it will be possible to effect the electrolysis at temperatures between approximately 50 and approxiately 75° C., according to the speciffic composition of the electrolyte in accordance with the gross composition.

In addition, the electrolyte of the invention has the advantage of not attacking the carbon anodes, which then have extremely long life in compraison to that observed in the present of baths containing more than about 5 to 20 mol % of $NH_4F$ in relation to $NH_4F+KF$.

Tests have shown that use of an electrolyte of which the $NH_4F$ content exceeds the limits just given causes accelerated wear of the carbon electrodes. This wear is one caused of lower performance and lack of reliability, particularly because of the wear of the bipolar electrodes.

It will be understood that in case of cracking or rupture of a bipolar electrode, the electrolysis gases formed on the two surfaces of the electrode can be mixed together and there is serious risk of explosion because of the great reactivity of hydrogen fluorine mixtures.

The electrolyzers according to Ser. No. 666,495 have permitted a solution to some of the problems which existed with the older electrolyzers equipped, for example, with monopolar electrodes and the discussion thereof is incorporated herein for a better understanding of the present invention. In fact, such electrolyzers allow a compact construction in which it is possible to have only two current connections, one to each end.

The voltage drop due to connections of electrodes in series from one electrolyzer to another is practically eliminated, due to bipolar electrodes and the working surface of each electrode is nearly equal to the inside cross section of the electrolyzer. To avoid hydrogen and fluorine mixtures, it is necessary to tightly join the edges of the electrodes to the walls and the top of the electrolyzer. This necessitates the use of an insulating material for the walls of the electrolyzer or at least for the inside surfaces of these walls. To reduce the losses of energy by Joule effect, and the corrosiveness of the bath, it is better to use an electrolyte with a high conductivity and a low melting point.

In spite of the reduction of the thermal losses, the smaller size of the electrolyzer for a same output makes it necessary to provide an effective cooling system. In the electrolyzers according to Ser. No. 666,495, the use of bipolar electrodes has been combined with the use of electrically insulating materials for the structural parts of the electrolyzers. These insulating materials are in contact with the electrolyte and with the gases evolved on the electrodes. The structural parts can be made of an inner conductive material such as steel which is covered on the outside by a layer of an electrically insulating material which alone comes in contact with the electrolyte and the gases. As discussed, the electrolyte is a mixture of $NH_4F$ and HF with an addition of KF in accordance with the parameters disclosed. In most cases, it is possible to have a working temperature in the order of between about 50 and about 75° C. A systemic circulation of the electrolyte is necessary for cooling when current densities corresponding to the needs of industrial production are used. The cooling is done by any means known in the art such as the use of double wall construction, or heat exchange tubes in which a cooling fluid is circulated. If necessary, one or several pump can accelerate the circulation of the electrolyte.

The following nonlimiting examples describe two different forms of electrolyzers according to Ser. No. 666,495, as utilized in the process of the present invention.

EXAMPLE I

The following electrolyzer is a relatively small unit which can be easily increased in size for industrial purposes.

Figure 3:
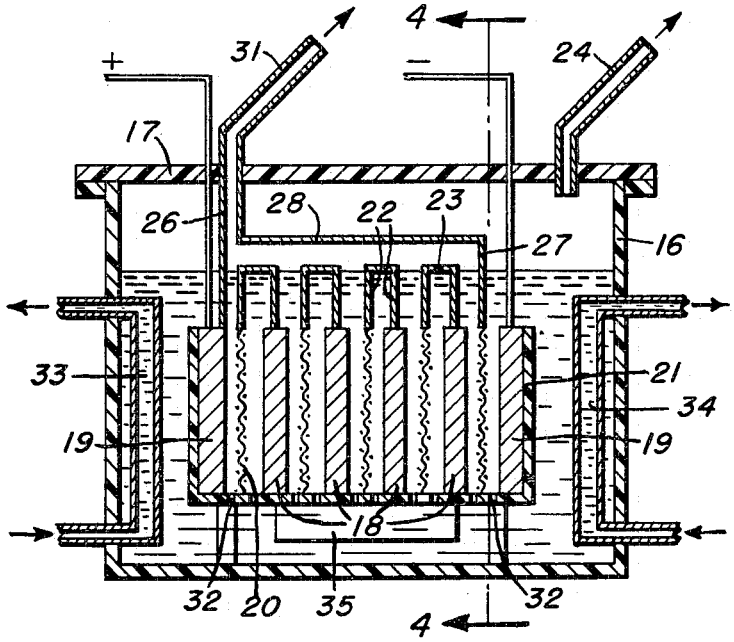
FIG. 3 is a section perpendicular to the electrodes of an electrolyzer according to Serial No. 666,495, comprising a double tank.
Figure 4:
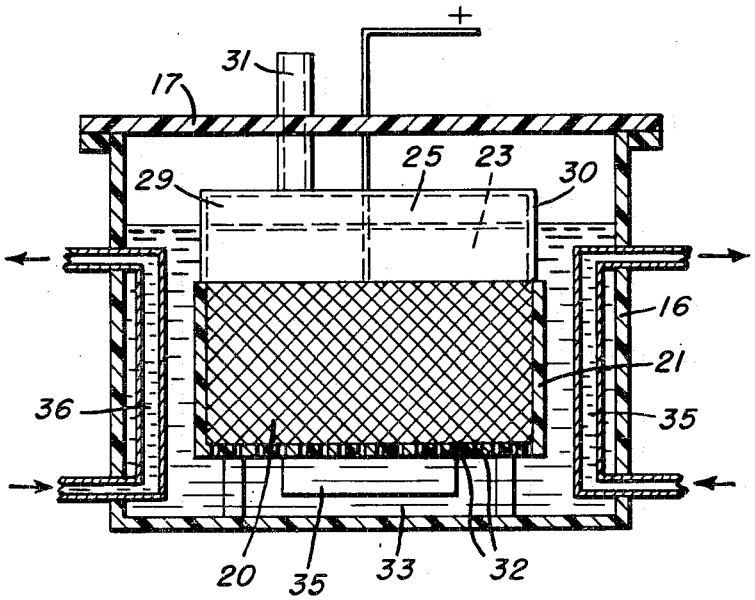
FIG. 4 is a section parallel to the electrodes of the electrolyzer of FIG. 3.

FIG. 3 and FIG. 4 represent this electrolyzer along two views at right angles. It comprises a tank 16 formed of polymethylmethacrylate with an insulated top 17 of the same material with six vertical carbon electrodes, four being bipolar 18 and two monopolar 19. The two monopolar electrodes at each end are connected to positive and negative poles of a DC current source. Each electrode is tightly joined to the walls and the bottom of the inner tank 21 inside the main tank 16. This inner tank 21 is also formed of polymethylmethacrylate. Between two electrodes, a diaphragm 20 made of graphite cloth separates anodic and cathodic zones.

The diaphragms and electrodes are completely immersed and joined tightly to "Monel" partitions 22 placed at their top and whose lower end penetates a few centimeters in the electrolyte. Above cathodic zones, the vertical partitions 22 ar joined by horizontal partitions 23 to form inverted gutters. Hydrogen gas is collected in these gutters and fills the top part of the tank 16 before going out through pipe 24.

Above the anodic zones, fluorine is collected in a volume 25 limited by "Monel" partitions 26, 27, 28, 29 and 30 which are tightly assembled together by welding. Fluorine product thus collected in 25 is then discharged from the electrolyzer through the pipe 31 and is collected in receiver means not shown.

Teflon gaskets are used to make all connections gas tight and also to electrically isolate the "Monel" partitions 22 and the diaphragms and carbon electrodes to which then are assembled. Circulation of the electrolyte for cooling is accomplished by use of thermosiphon means. To obtain this result, the bottom of the inner tank 21 has holes 32 which allow free circulation of the electrolyte from the outside to the inside of inner tank 21. In the upper part of the cathodic zones, the electrolyte communicates freely through the inverted gutters with the space between the two tanks.

The Joule effect increases the temperature of the electrolyte in the spaces between the electrodes whereas the water cooling system 33, 34, 35, 36 lowers that temperature in the space between the two tanks 16 and 21 thus creating a hydrodynamic flow. The flow of hydrogen through the inverted gutters also facilitates this flow. With the electrolyte composed of 20 mol % of $NH_4F$ in relation to a complementary 80 mol % KF, and HF content of 45% by weight in relation to the $NH_4F+KF+HF$ total, it is possible to maintain its average operating temperature at about 55° C.

With this electrolyzer and this electrolyte, an operating test of 800 hours was done in the following conditions: the useful surface of each side of the electrodes was 2.4 $dm^2$; the distance in the electrolyte between two successive electrodes was 2 cm; the average current total intensity 36 amperes; with a total voltage of 30 volts; that is to say, 6 volts per element. Fluorine production was 67.6 l/h corresponding to a 94% Faraday efficiency. The concentration of HF in the fluorine was 3% in volume instead of about 6 to 8% as in an electrolyzer utilizing prior art electrolytes without addition of $NH_4F$. The comsumption of energy is about 38% lower, due to the lower voltage, which represents a significant advantage. That consumption is only 2% higher than in the electrolytes described in Ser. No. 666,495. This slight inconvenience is more than compensated for by the fact that the carbon electrodes are not corroded at all by the electrolyte after this 800 hour test. Former tests done with electrolytes containing more than 20 mol % of NHF had shown a beginning of corrosion of the carbon electrodes after the same testing time. This means that with this electrolyte the usefull life of the carbon electrodes is considerably increased. This means also that the useful life of the electrolyzer itself is also increased in the same proportion.

In this exemplary electrolyzer, structural modifications can be made without departing from the scope of the process of the present invention. Especially, it is possible to use several other plastic materials such as polyethylene, polypropylene, or polycarbonates. It is possible also to use polytetrafluorethylene and polytetrafluorochlorethylene. These last materials can also be used for gaskets. Instead of using structural members of solid plastic, it is possible, also as noted earlier, to use another material, such as steel, protected by a layer of plastic.

Polycarbonates are excellent synthetic resin plastic materials which can be used for electrolysis cells which function up toward 70° to 80° C. Very good results are also obtained with a copolymer of chlorotrifluorethylene and ethylene, i.e., HALAR, which is a trademark of the Allied Chemical Company. This copolymer has a particular advantage of being able to be used in the form of thin coatings. Thus an electrolyzer of the type described in Example I has been provided in which the outer tank 16, the inner tank 21 and the cover 17 of FIGS. 3 and 4 are formed of sheet steel covered with HALAR in the place of polymethylmethacrylate. Also, the "Monel" partitions described in the Example have been replaced by partitions of sheet steel coated with HALAR. Tests have shown an excellent resistance of this material with respect to the electrolyte and also to electrolysis gases. The circulation of the electrolyte can be accelerated by a pump. A pump made, for example, of graphite can be placed between the two tanks or even on the outside of the electrolyzer.

In comparison with the previous apparatus, such an electrolyzer is an improvement because of its compactness, its energy efficiency and the quality of the fluorine produced. However, its complexity due to the double tank for the circulation of the electrolyte, and the collecting system for produced gases makes it expensive. The efficiency of the collection of fluorine and hydrogen depends on the tightness of the partitions placed in the upper part of the electrolyzer. Accidents may result from faulty welds or gaskets.

EXAMPLE II

A second electrolyzer, which is of sturdier construction, was used in carrying forth another exemplary embodiment of the process of the present invention, which electrolyzer was also constructed according to Ser. No. 66,495.

Figure 5:
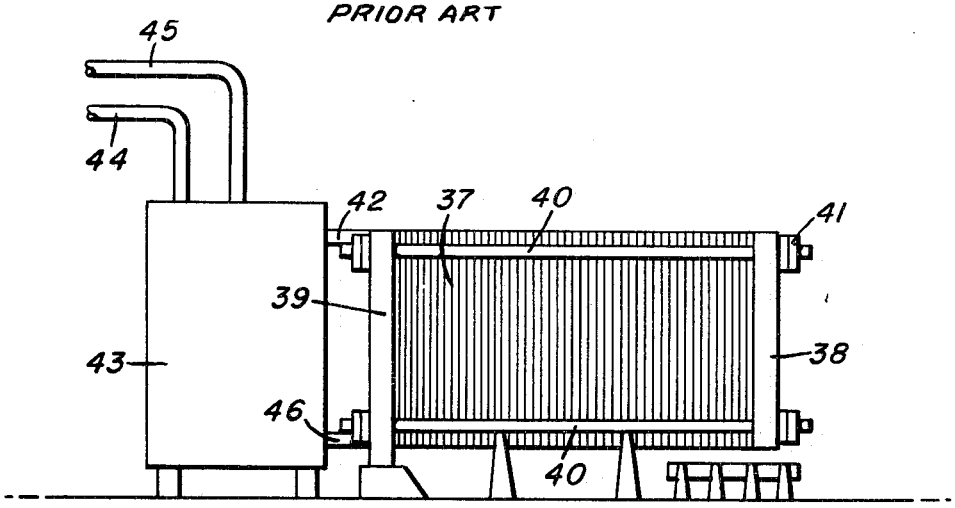
FIG. 5 PRIOR ART
FIG. 5 shows a known press electrolyzer for electrolysis of water.

This electrolyzer incorporates, in part, the teachings of "Applications de l'Electrochimie" by W. A. Koehler, published by Dunod-Paris 1950. In this book, an electrolyzer of the press filter type designed by Pechkranz is described at pages 388–389, FIGS. 146–147. It is an electrolyzer for production of $O_2$ and $H_2$ from water. FIG. 5 is a general view of this electrolyzer wherein 37 shows generally a structure characterized by anodic and cathodic compartments separated by a porous diaphragm. Bipolar electrodes are maintained between two cast iron end plates 38, 39 by means of threaded rods 40 and nuts 41. Electrically insulated and tightly joined gaskets are disposed between electrodes and diaphragms. Positive and negative electrical leads are connected to the end plates 38 and 39 which are insulated from the rods and the bottom. These end plates are in fact the two outer electrodes of this electrolyzer. Two pipes 42, only one of which is visible, are connected, one to the anodic compartments, and the other one to the cathodic compartments. They carry respectively hydrogen gas and oxygen gas in the two compartments of the separator 43. These compartments are not shown in the figure. In one of these compartments, hydrogen gathers in the upper part and is discharged through pipe 44 to receiving means, not shown. In the second compartment, oxygen gathers in the same way and discharges through pipe 45 to receiving means not shown.

Figure 6:
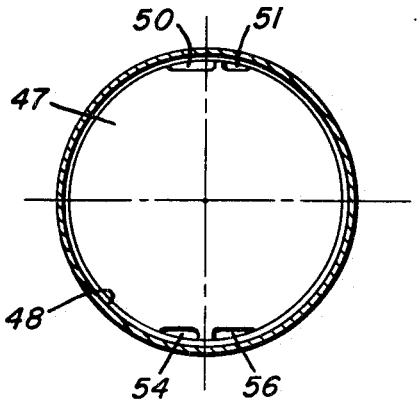
FIG. 6 PRIOR ART
FIG. 6 and FIG. 7 show respectively a bipolar electrode and a diaphragm of the press of electrolyzer of FIG. 5.
Figure 7:
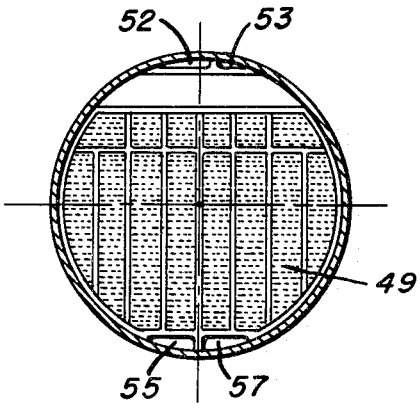
FIG. 7 PRIOR ART

The electrolyte from separator 43 comes back to the electrolyzer by two pipes 46, only one of which is visible. FIG. 6 shows a bipolar electrode used in the electrolyzer. It is made of mild steel, nickel plated on one face, the anode face. Around the anode, there is a groove 48 for an electrically insulated rubber gasket. In the electrolyzer 37, this gasket will come in contact with the diaphragm 49 shown in FIG. 7. This diaphragm is made of a nickel sheet which is provided with a multitude of small holes. The other side of the electrode 47 in the electrolyzer will come in contact with another diaphragm such as 49 by means of another gasket. The thickness of the gaskets determines the width of the anodic and cathodic compartments.

Electrodes 47 and diaphragms 49 have orifices which are joined together by gaskets so as to form passages all along the electrolyzer. Electrodes and diaphragm orifices 50 and 52 collect hydrogen. On the contrary, electrodes and diaphragm orifices 51 and 53 collect oxygen. outlets (not shown) are provided from each cathodic and anodic compartment respectively through the junction between 50 and 52 and the junction between 51 and 53. Hydrogen and oxygen thus collected, together with some quantities of electrolyte, pass through pipes 42 to the separator 43 as explained before.

Electrodes and diaphragms have in their lower part orifices 54, 55, 56 and 57 through which electrolyte separated in 43 returns to the electrolyzer. Inlets (not shown) are provided through the junction between 54 and 55 and between 56 and 57. In this way, the electrolyte coming back from the hydrogen compartment of the separator returns to the cathodic compartments and the electrolyte from the oxygen compartment of the separator returns to the anodic compartments.

Such an electrolyzer is not generally practical for industrial production of fluorine, because the materials used are not resistant to fluorine or fluorides. If instead of iron electrodes, carbon electrodes are used, it is easy to see that the same kind of structure cannot generally be utilized due to the brittleness of carbon electrodes. But, as disclosed in Ser. No. 666,495, it has been found that it would be highly desirable to provide an electrolyzer which could be disassembled more easily than the electrolyzer described in Example I. In Example II, the electrolyzer which is described in carrying forth another exemplary mode of the present invention, can be easily disassembled.

Figure 8:
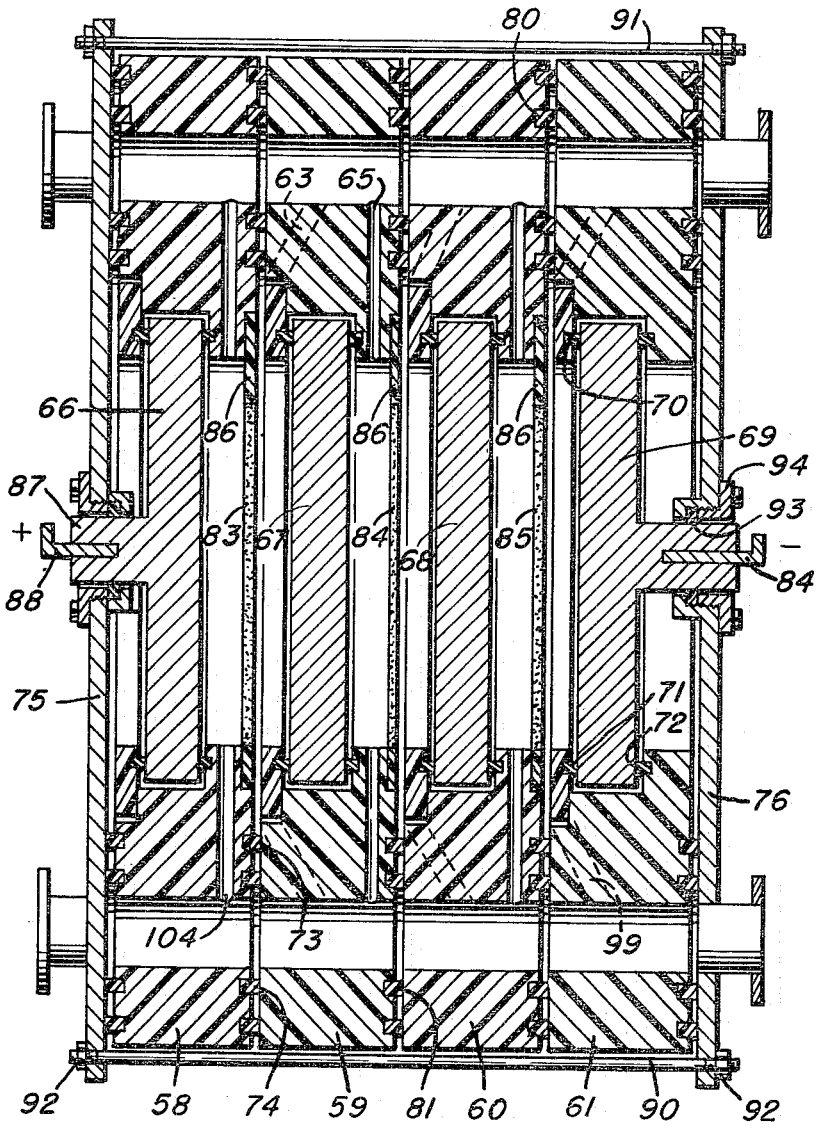
FIG. 8 is a section perpendicular to the electrodes of an electrolyzer according to Ser. No. 666,495 whose structure is made of assembled frames.
Figure 10:
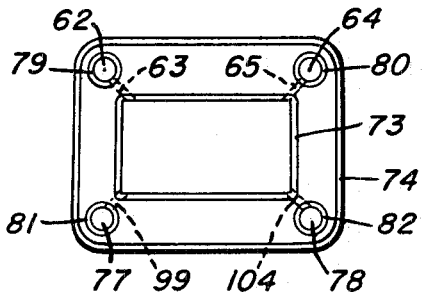
FIG. 10 shows one frame according to Ser. No. 666,495.

FIG. 8 represents an electrolyzer according to Ser. No. 666,495 and comprising only three elementary cells in series to facilitate the understanding of its assembly. This electrolyzer is composed of four polymethylmethacrylate frames 58, 59, 60, 61 with orifices at each corner as seen in FIG. 10. Orifice 62 is connected by ducts 63 drilled through the frame to the cathodic compartment of each elementary cell and collects hydrogen from this compartment Orifice 64 is connected by ducts 65 to the anodic compartments of each elementary cell and collects fluorine gas. Inside each frame, there are carbon electrodes 66, 67, 68, 69 fixed with a suitable clearance to avoid mechanical tension, resulting for example, from thermal expansion, within a housing machined in the frame.

A second removable frame 70 formed of like material maintains the carbon electrode in the housing. It is held in place by screws or adhesive. Each electrode is sealed tightly to the frames by gaskets 71, 72. These gaskets must resist corrosion caused by the electrolyte and the gas. They must not leak and nevertheless they must be resilient enough to accommodate some differential thermal expansion. For that application, polytrifluorochlorethylene gaskets give satisfactory results. Each main frame is insulated from the next one with a gasket of polytrifluorochlorethylene 73, 74. FIG. 10 shows that gasket 73 follows the inner edge of the frame, and gasket 74 the other edge. "Monel" plates close opposite faces 75, 76. FIG. 10 shows that each orifice 62, 64, 77, 78 is encircled by a gasket 79, 80, 81, 82. Diaphragms 83, 84, 85 separate anodic and cathodic compartments. These diaphragms are surrounded by a polymethylmethacrylate thin frame 86 which is received in a housing machined in the main frame. The diaphragms themselves are porous walls made of pressed and sintered small polymethylmethacrylate balls having an individual diameter of a few tenths of a millimeter.

These porous walls have no electrical resistance but prohibit gas diffusion. Electrodes 66 and 69 are monopolar and connected to the direct current source. Electrode 66 is a carbon anode which is extended on one side by a cylindrical carbon part 87 in which a copper lead 88 is secured. In the same way, the cathode 69 is connected to the current source by the copper lead 89. Four threaded rods, of which two, 90, 91 with nuts 92, 92', are visible, are attached to the four corners of each end plate 75, 76, and maintain the assembly together. The rods and bolts are insulated from the end plates by usual means, not shown. The cylindrical carbon extension of the end electrodes 66 and 69 are tightly joined to the end plates by polytrifluorochlorethylene gaskets such as 93 compressed by the threadably engaged annular part 94.

Figure 9:
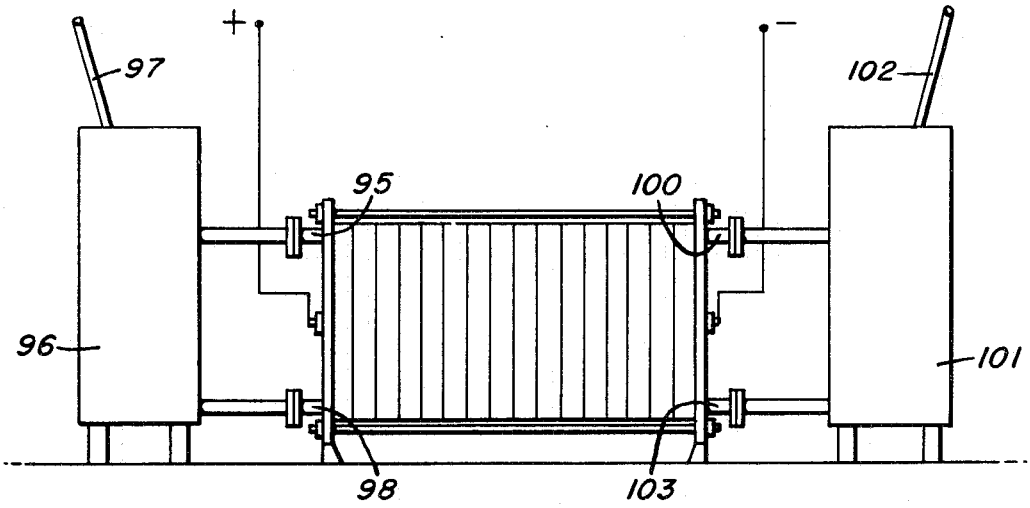
FIG. 9 shows an electrolyzer according to Ser. No. 666,495 whose structure is made of assembled frames, seen from outside with its separators.

FIG. 9 shows a cell with sixteen frames, or fifteen elements. These elements are identical to those of FIG. 8. As described previously, during electrolysis, hydrogen gas is collected in 62 and passes through the end plate by pipe 95 which is connected to separator 96. From this separator, hydrogen is conducted by pipe 97 to receiving means not shown. The electrolyte which was carried by the hydrogen flow returns to the electrolyzer from the separator by a pipe 98 and orifice 77, and ducts 43. Fluorine product is collected in 64 and goes through pipe 100 to separator 101. It is delivered to receiving means by pipe 102. The electrolyte separated returns to the anodic compartments through pipe 103, orifice 78 and ducts 104.

Pipes 95, 98, 100, 103 are formed of "Monel" as are the separators 96, 101. In these separators, the electrolye is cooled by means of a cooling fluid circulation in a double wall to the desired temperature before coming back to the electrolyzer. Pumps may be used to accelerate the circulation of the electrolyte. These pumps may be made of graphite. An electrolyzer as shown in FIG. 8, with three elementary cells in series, has been tested for 800 hours with an electrolyte composition of 5 mol % $NH_4F$ in relation to a complementary 95 mol % KF and HF content of 40% by weight in relation to the $NH_4F+KF+HF$ total. The distance between electrodes was 2 cm and the working surface of each electrode, measured on one side, was 2.4 $dm^2$. Electrical current was 35 A and voltage 18 volts (6 volts per element).

Under these conditions, the production of fluorine was 39.6 l/h measured under normal conditions of temperature and pressure. This is corresponding to a Faraday efficiency of 95%. The working temperature was about 75° C. and HF content was around 4.5%. This electrolyzer has the advantage of a higher degree of compactness than the electrolyzer described in Example I. Its design is simmpler and more sturdy. The ability to dismantle it easily is a great adavantage for maintenance. Finally, it has an energy efficiency as high as the electrolyzer of Example I. For the building of this electrolyzer, it is possible to use other materials than those described. For the frames, instead of polymethylmethacrylate, it is possible to use polycarbonates or polyfluorinated polymers, such as polytetrafluorethylene or polychlorofluorinated polymers such as polytrifluorochlorethylene or eventually other plastic materials such as polypropylene or polyethylene.

For diaphragms, it is possible to use plastic material of various structural configurations, e.g., sintered particles, perforated sheets, or woven fibers. Instead of plastics, carbon fibers or tissue, or sintered alumina can be used. Metals or alloys such as nickel or "Monel" can be employed also for diaphragms made of perforated sheets or fine wire screens. Further, it is possible to use diaphragms made of plastic or carbon fibers reinforced by metallic wires.

For the electrodes, instead of carbon, it is possible to use other materials such as "Monel" or nickel, especially for the cathodic side. For bipolar electrodes, a duplex structure associating, for example, carbon on the anodic side and a metal on the cathodic side, is contemplated. The fastening of the electrode inside the frames can be done by means other than gaskets such as shown in FIG. 8.

Figure 11:
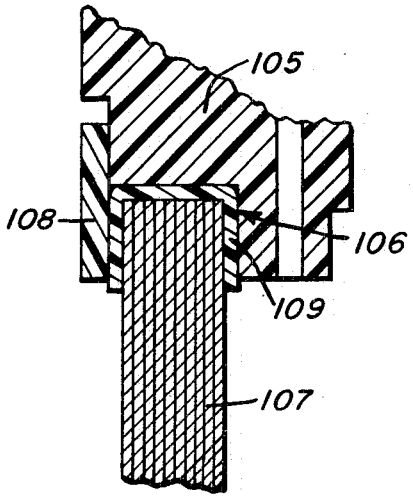
FIG. 11 shows a detail of a tight joint between an electrode and a frame according to Ser. No. 666,495.

FIG. 11 shows a different way in which a carbon electrode can be joined tightly to a plastic frame. In that figure, which is a transverse section, there is shown a part of the frame 105 with the housing 106 in which is loosely fitted the edge of the electrode 107. The housing is closed by part 108 which is a removable second plastic frame which is screwed or otherwise secured to the main frame. The clearance between the edge of the electrode and the housing is maintained by a soft and resilient material 109 which envelopes the edges of the electrode. This material is a carbon tissue, and can be also a plastic tissue made, for example, of polytetrafluorethylene. In this way, the carbon electrode is joined tightly to the frame, but some slight displacements are possible without undue stresses. Part 108 can also be formed by casting the plastic material as a liquid monomer after having placed the electrode with its edges protected in the way just described, in the housing, and later polymerizing it.

Experiments carried out on sample cells as discussed above have shown that it is possible to limit the corrosive action of electrolytes made of mixtures of $NH_4F+HF$ by adding KF to them, and that such introduction of KF within the parameters disclosed provides improved electrolytes that enhance fluorine production and increase the life of the carbon electrodes. Table I gives examples of compositions of electrolytes in accordance with the invention and comprising the ternary electrolyte $NH_4F+HF+KF$ together with their respective melting points.

TABLE I

| Bath No. | Contents of $NH_4F$ and KF in mole percent of $NH_4F$ + KF: $NH_4F$ | KF | HF in weight percent of $NH_4F$ + KF + HF | Melting Points |
|---|---|---|---|---|
| 1 | 20 | 80 | 45 | 45° C. |
| 2 | 9 | 91 | 42 | 55° C. |
| 3 | 5 | 95 | 40 | 60° C. |

It will be seen from the Table that the melting point of the electrolyte increases slowly when the percentage of KF is increased. When the percentage becomes higher than about 95%, the melting point of the electrolyte is generally too high for use in an electrolyzer made of plastic materials.

FIG. 12 is a diagram in which the useful range of composition of an electrolye according to the invention is generally presented. In this diagram the percentages of KF in mole percent of $NH_4F+KF$ are in abscisses and the percentages of HF in weight percent of $NH_4F+HF+KF$ in ordinates, the useful range of composition of the electrolyte is represented generally by the striped region.

Electrolyzers can be operated at a pressure higher than atmospheric pressure in carrying forth the process of the present invention. This result can be obtained by means known in the art. If the mechanical resistance of the structure of the electrolyzer is not high enough for the pressure which is needed, it is possible to place this electrolyzer, and also the separators, in a pressurized tank. It is then possible to fill cylinders directly with hydrogen and fluorine at the required pressure.

In this process, the necessary adjustments of the electrolyte, to maintain the parameters disclosed, can be done easily by introduction of the ternary constituents from time to time as predetermined additions in the separators.

We claim:

1. In a process for the production of fluorine by electrolysis of a ternary electrolyte comprising as essential constituents $NH_4F+KF+HF$ in an electrolytic cell, the improvement comprising:

(a) operating the cell with the ternary electrolyte having the composition:

$NH_4F$=about 5 to about 20 mol % of $NH_4F+KF$

HF=about 40 to about 45% in weight percent of $NH_4F+KF+HF$;

and (b) maintaining the working temperature of the electrolyte between about 50 and about 75° C.

2. The process of claim 1 including carrying forth the process in an electrolyte cell provided with generally inert synthetic resin protection against corrosion.

3. The process of claim 1 operated with the ternary electrolyte having the composition:

$NH_4F$=about 20 mol % of $NH_4F+KF$

HF=about 45% in weight percent of $NH_4F+KF+HF$

4. The process of claim 1 operated with the ternary electrolyte having the composition:

$NH_4F$=about 9 mol % of $NH_4F+KF$

HF=about 42% in weight percent of $NH_4F+KF+HF$

5. The process of claim 1 operated with the ternary electrolyte having the composition:

$NH_4F$=about 5 mol % of $NH_4F+KF$

HF=about 40% in weight percent of $NH_4F+KF+HF$

* * * * *